US011998045B2

(12) United States Patent
Meszaniec

(10) Patent No.: US 11,998,045 B2
(45) Date of Patent: Jun. 4, 2024

(54) ADAPTER DEVICE FOR SUPPORTING A SCREEN MEMBER RELATIVE TO THE SMOKE INLET TUBE OF A WATER PIPE

(71) Applicant: Kyle Micheal Meszaniec, Prince Albert (CA)

(72) Inventor: Kyle Micheal Meszaniec, Prince Albert (CA)

( * ) Notice: Subject to any disclaimer, the term of this patent is extended or adjusted under 35 U.S.C. 154(b) by 232 days.

(21) Appl. No.: 17/492,075

(22) Filed: Oct. 1, 2021

(65) Prior Publication Data

US 2022/0104541 A1 Apr. 7, 2022

Related U.S. Application Data

(60) Provisional application No. 63/086,288, filed on Oct. 1, 2020.

(51) Int. Cl.
*A24F 5/08* (2006.01)
*A24F 1/30* (2006.01)

(52) U.S. Cl.
CPC . *A24F 1/30* (2013.01); *A24F 5/08* (2013.01)

(58) Field of Classification Search
CPC .. A24F 1/30; A24F 5/00; A24F 40/485; A24F 3/00; A24F 5/10; A24F 1/00; A24F 2700/08; A24F 5/08
See application file for complete search history.

(56) References Cited

U.S. PATENT DOCUMENTS

| | | | | |
|---|---|---|---|---|
| 3,292,634 | A * | 12/1966 | Beucler | A24D 1/14 131/183 |
| 3,790,015 | A * | 2/1974 | Imamura | B65D 50/045 215/209 |
| 4,682,610 | A * | 7/1987 | Freelain | A24F 1/30 131/210 |
| 2013/0146070 | A1* | 6/2013 | Ross | A24F 1/30 131/225 |
| 2018/0042413 | A1* | 2/2018 | Althaher | B65D 43/0214 |
| 2019/0082732 | A1* | 3/2019 | Bautista | A24F 1/32 |
| 2020/0093176 | A1* | 3/2020 | Aznavour | A24F 1/30 |
| 2020/0352223 | A1* | 11/2020 | Righter | A24F 1/28 |

FOREIGN PATENT DOCUMENTS

| | | | | |
|---|---|---|---|---|
| EP | 3566593 | A1 * | 11/2019 | A24F 1/24 |

* cited by examiner

*Primary Examiner* — Eric Yaary
(74) *Attorney, Agent, or Firm* — Ryan W. Dupuis; Kyle R. Satterthwaite; Ade & Company Inc.

(57) ABSTRACT

A screen adapter device supports a screen member relative to a smoke inlet tube of a water pipe that has a water container coupled between a drawtube and the smoke inlet tube. The screen adapter device has an adapter plate with a screen aperture supporting the screen member releasably therein. The adapter plate has an outer diameter which is greater than an inner diameter of the smoke inlet tube to be supported spanning across the inlet end of the smoke inlet tube. The device is easily disassembled for ease of cleaning or replacing the screen. Optionally, a resilient support body is joined to the adapter plate assists in securing the adapter plate on the smoke inlet tube.

21 Claims, 6 Drawing Sheets

ADAPTER DEVICE FOR SUPPORTING A SCREEN MEMBER RELATIVE TO THE SMOKE INLET TUBE OF A WATER PIPE

This application claims the benefit under 35 U.S.C. 119(e) of U.S. provisional application Ser. No. 63/086,288, filed Oct. 1, 2020.

FIELD OF THE INVENTION

The present invention relates to a screen adapter for mounting a screen member in place of a bowl on the smoke inlet pipe of a water pipe including a water container coupled between a drawtube and the smoke inlet tube.

BACKGROUND

A typical water pipe includes (i) a main pipe defining a container at the bottom end of the pipe for containing a volume of liquid therein and a drawtube extending above the container to accept the mouth of a user for smoking, and (ii) a smoke inlet pipe having an open inlet end external of the main pipe to receive a bowl for combusting a smoking substance therein and an outlet end in communication with the container of the main pipe at a location below a level of the liquid contained therein. A typical bowl is known to easily clog and thus requires frequent cleaning.

U.S. Pat. No. 9,930,911 by Wright discloses an example of a bowl assembly for a water pipe that intends to reduce the amount of ash entering into the liquid within the container during use; however, the bowl contains numerous intricate components that remain difficult and time consuming to clean.

SUMMARY OF THE INVENTION

According to one aspect of the invention there is provided a screen adapter device for supporting a screen member relative to a smoke inlet tube of a water pipe including a water container coupled between a drawtube and the smoke inlet tube, the screen adapter device comprising:

an adapter plate having a screen aperture arranged to support the screen member releasably therein;

the adapter plate having an outer diameter which is greater than an inner diameter of an inlet end of the smoke inlet tube so as to be arranged to be supported spanning across the inlet end of the smoke inlet tube.

The screen adapter device according to the present invention allows a screen member to be supported relative to open inlet end of the smoke inlet tube of a water pipe provides a simpler structure for smoking a smoking substance, while also remaining easily able to be disassembled for ease of cleaning between uses. The screen can also be inexpensively replaced at any time.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
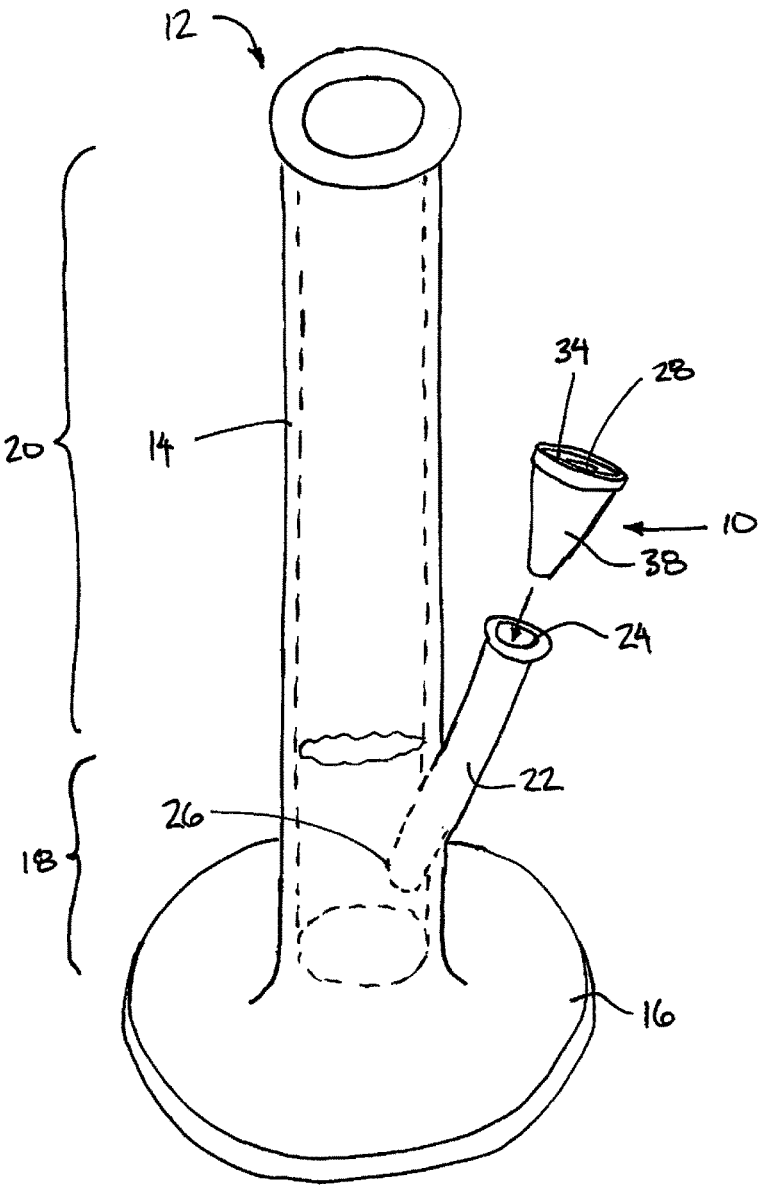
FIG. 1 is a perspective view of an exemplary water pipe with which the screen adapter device according to the present invention can be used together with a first embodiment of the screen adapter device shown separated from the water pipe.

Referring to the accompanying figures there is illustrated a water pipe screen adapter device generally indicated by reference numeral 10. The device 10 is particularly suited for use with a water pipe 12 of the type used to smoke a smoking substance such that the resulting smoke from combustion of the smoking substance passes through water contained within the water pipe.

According to one example of a water pipe, the water pipe includes a pipe body 14 in the form of an upright tube fixed onto a base 16 at the bottom end thereof such that the tube is enclosed at the bottom end. The pipe body defines a container portion 18 within the lower portion of the upright tube which is suitable for containing a liquid such as water therein. The pipe body 14 further defines a draw tube portion 20 as the portion of the pipe body extending above the liquid within the container portion 18 below. The draw tube portion extends upwardly to an open top end of the pipe body which is adapted for being engaged by the mouth of a user to draw air through the draw tube portion when smoking.

In the illustrated example of the water pipe 12, a smoke inlet tube 22 is provided which extends through the wall of the pipe body 14 below the draw tube portion 20. The smoke inlet tube 22 includes an inlet end 24 supported externally of the pipe body 14 at a location spaced above the liquid level within the container portion 18. An opposing outlet end 26 of the smoke inlet tube is located internally within the pipe body within the container portion to be submerged below the level of liquid therein.

Under normal use of the water pipe 12, a bowl is provided within the inlet end of the smoke inlet tube 22 for receiving and combusting the smoking substance therein. When a user provides suction at the open top end of the draw tube portion 20 with their mouth, air is drawn into the bowl to assist in combustion of the smoking substance, followed by smoke being drawn through the container of water that is coupled between the smoke inlet tube 22 and the draw tube portion 20 so that the smoke passes through the water and up through the draw tube portion to the open top end of the pipe body 14.

The screen adapter 10 according to the present invention is mounted in place of a bowl at the open inlet end of the smoke inlet tube 22 for supporting a screen member 28 relative to the smoke inlet tube 22. The screen member 28 includes a bowl portion 30 formed of wire mesh in a semi-spherical shape to have a convex bottom side and a concave upper side. The bowl portion 30 includes an upper rim surrounding an open top end of the screen member. An annular flange 32 of the screen member 28 is joined to the rim of the bowl portion 30 about the full perimeter thereof to extend radially outward beyond the bowl portion below.

Although various embodiments of the screen adapter are illustrated in the accompanying figures, the features in common with the various embodiments will first be described.

The screen adapter 10 generally comprises an adapter plate 34 locating a screen aperture 36 therein within which the screen member 28 can be supported. The adapter plate is typically supported such that it can be lifted from the normal operating condition into a venting condition allowing air to bypass the screen member into the smoke inlet tube.

The adapter plate 34 is typically formed of a rigid material, for example a plate of glass, a plastic material, or wood. The screen aperture 36 in the adapter plate typically comprises a bore extending fully through the plate from the top side to the bottom side and having an inner diameter which is equal to or slightly greater than the outer diameter of the bowl portion 30 of the screen member. A counterbore 42 is formed at the top side of the screen aperture 36 in concentric alignment with the bore forming the screen aperture in which the counterbore has a larger diameter.

Preferably the interior diameter of the counterbore is approximately equal to or slightly greater than the outer diameter of the annular flange 32 of the screen member 28 while an axial depth of the counterbore is approximately equal to the excess of the annular flange. In this manner the counterbore 42 receives the annular flange 32 of the screen member 28 therein so that the annular flange 32 is engaged upon a shoulder formed between the counterbore 42 and the remainder of the screen aperture 36 extending therebelow and so that the annular flange 32 is substantially flush with the top side of the adapter plate 34.

Figure 9:
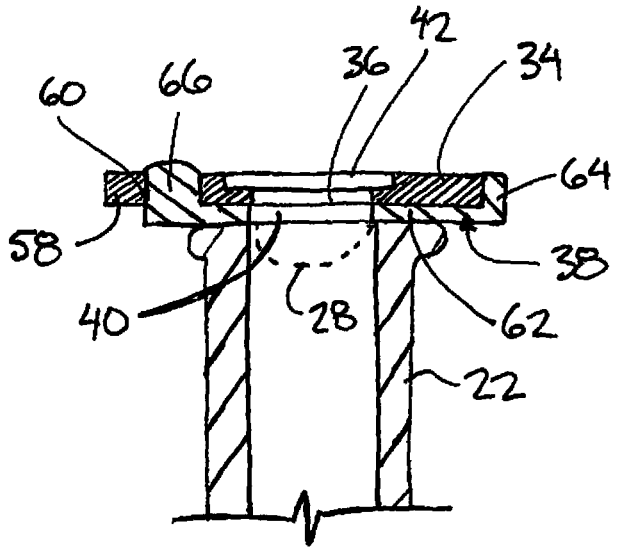
FIG. 9 is a sectional view along the line 9-9 in FIG. 8 illustrating the screen adapter device according to the third embodiment of FIG. 7 supported on the open inlet end of the smoke inlet tube of a water pipe.

In this manner the bowl portion 30 is suspended from the annular flange 32 by extending downwardly through the screen aperture 36 so that a bottom of the bowl portion 32 is spaced below the adapter plate 34. The outer diameter of the bowl portion at the upper rim of the bowl portion immediately below the annular flange 32 is approximately equal or slightly greater than an interior diameter of the screen aperture 36 at the bottom side of the adapter plate. Accordingly, the insertion of the bowl portion through the screen aperture requires overcoming some friction. The resulting interference fit of the screen member 28 into the screen aperture 36 frictionally retains the screen member 28 mounted within the adapter plate 34. Furthermore, the outer diameter of the bowl portion at the upper rim of the bowl portion immediately below the annular flange 32 is preferably only slightly undersized relative to the inner diameter at the inlet end of the smoke inlet tube. For example, as shown in FIG. 9, the outer diameter of the bowl portion 32 may be 13 millimetres when the inner diameter of the smoke inlet tube 22 is 14 millimetres, or the outer diameter of the bowl portion 32 may be 17 millimetres when the inner diameter of the smoke inlet tube 22 is 18 millimetres. This assists in centering the screen member 28 relative to the smoke inlet tube 22.

A support body 38 may optionally support the adapter plate 34 relative to the inlet end of the smoke inlet tube 22 and includes a passage 40 extending through the support body between the screen aperture 36 supporting the screen member therein and the smoke inlet tube 22 below the screen member.

When the adapter plate 34 is supported on the smoke inlet tube 22, in a normal operating condition of the device 10, air drawn into the smoke inlet tube must pass through the screen member due to the configuration of the adapter plate and/or the support body 38. The support body 38 typically supports the adapter plate such that the adapter plate 34 can also be lifted from the normal operating condition into a venting condition allowing air to bypass the screen member into the smoke inlet tube.

The support body 38 is typically formed as a continuous, seamless, unitary body of resilient material having a high coefficient of friction relative to the material of the smoke inlet tube which is usually formed of glass. The support body thus frictionally grips the smoke inlet tube to support the rigid adapter plate 34 in a desired relationship relative to the smoke inlet tube.

Figure 2:
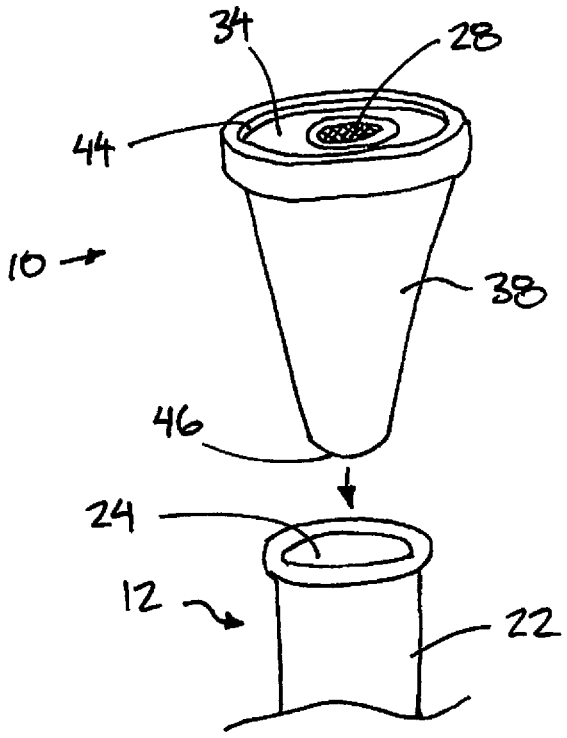
FIG. 2 is a perspective view of the screen adapter device according to the first embodiment of FIG. 1.
Figure 3:
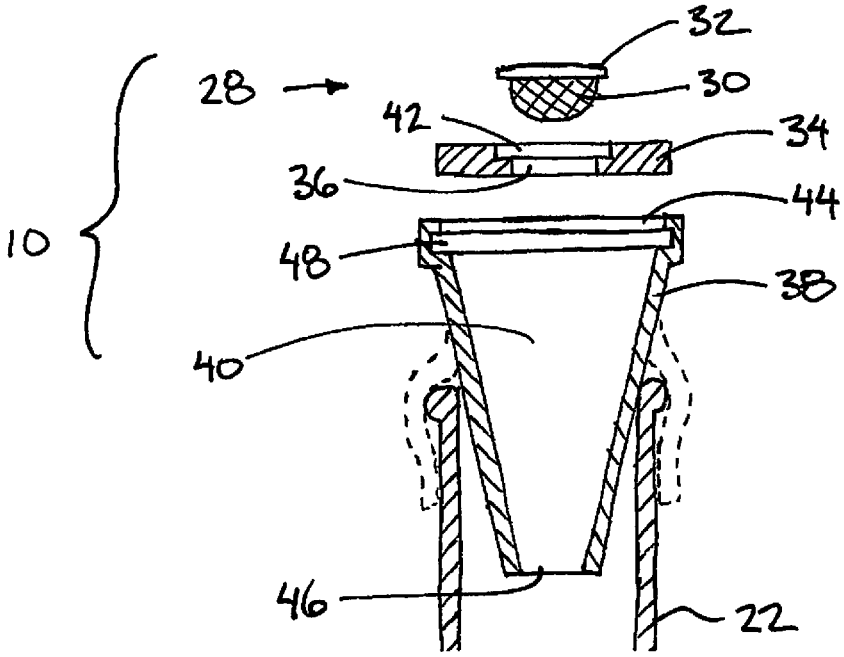
FIG. 3 is a sectional view of the screen adapter device according to the first embodiment of FIG. 1 in which the screen adapter device is shown in a relaxed condition in solid line and in a stretched condition in broken line.

Turning now to the first embodiment of FIGS. 1 through 3, the support body 38 in this instance is generally frusto-conical in shape such that the tubular body is tapered downwardly and inwardly from a top opening 44 at a top end to a bottom opening 46 at a bottom end of the support body. A perimeter groove 48 is recessed into the inner surface of the support body to extend about the circumference of the top opening 44 in proximity to the top end of the support body. The inner diameter of the support body 38 at the perimeter groove 48 is approximately equal to or slightly undersized relative to the outer diameter of the adapter plate 34 which is round in this instance. In this manner the resilient material of the support body 38 can be slightly stretched elastically to fit the outer diameter of the adapter plate 34 into the perimeter groove about the full circumference thereof.

The outer diameter of the support body 38 at the bottom end is less than the inner diameter of the open inlet end of the smoke inlet tube 22 so that the bottom end of the support body 38 can be readily received into the interior of the smoke inlet tube at the open top end thereof. The outer diameter at the top end of the support body 38, and the outer diameter of the adapter plate 34 supported therein is greater than the interior diameter at the open top end of the smoke inlet tube so that the support body 38 supports the adapter plate spaced above the open top end of the inlet tube while an intermediate portion of the support body 38 between the top and bottom ends thereof forms a complete sealing interface about the rim of the open top end of the smoke inlet tube.

When the bottom end of the support body 38 according to the first embodiment of FIGS. 1 through 3 is inserted into the smoke inlet tube 22 as shown in solid line in FIG. 3, the material forming the support body is in a relaxed condition. The material forming the support body 38 can be elastically stretchable from the relaxed condition to a stretched condition as shown in broken line in FIG. 3 in which the interior diameter at the bottom opening 46 and along the lower portion of the support body is equal to or greater than the outer diameter at the inlet end of the inlet tube so as to enable the bottom end of the support body 38 to fully surround the inlet end of the smoke inlet tube 22. With the bottom end of the support body 38 in an elastically stretched condition under tension about the smoke inlet tube, the bias of the material to return to the relaxed condition functionally grips the support body in fixed relation to the smoke inlet tube 22 while maintaining a complete seal between the perimeter of the adapter plate 34 and the exterior surface of the smoke inlet 22.

Figure 5:
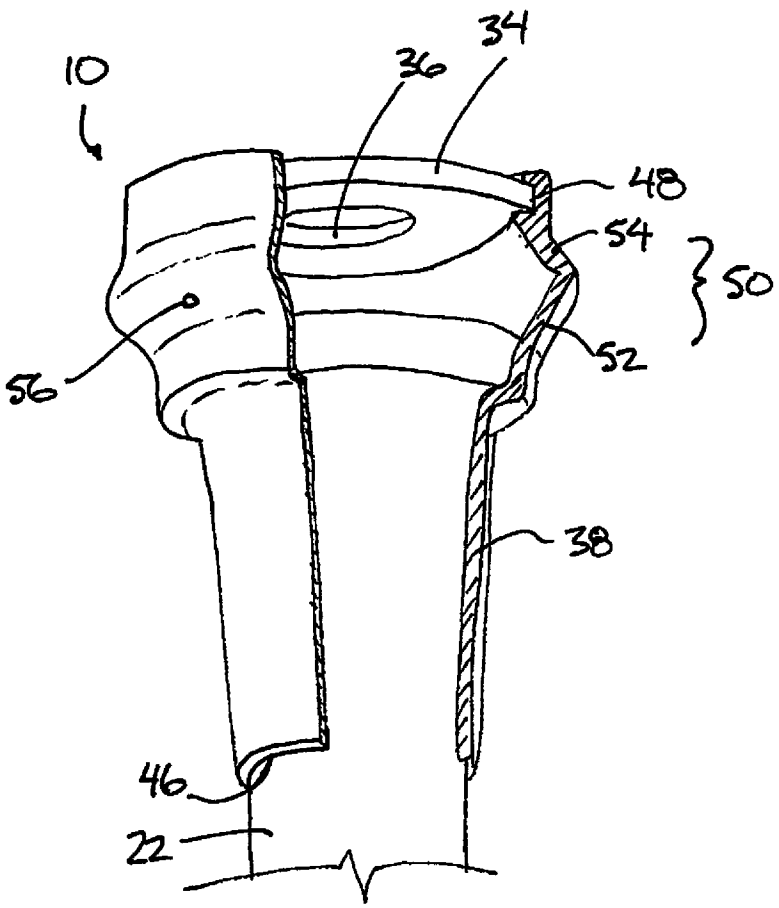
FIG. 5 is a partly sectional perspective view of the screen adapter device according to the second embodiment of FIG. 4 shown in the open condition.
Figure 4:
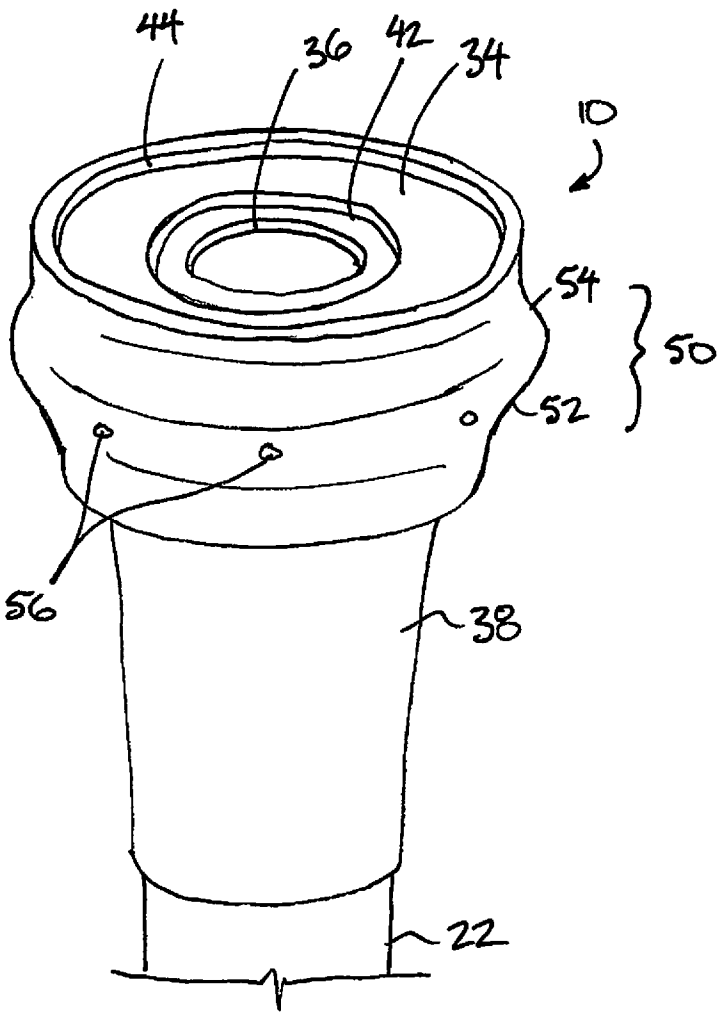
FIG. 4 is a perspective view of a second embodiment of the screen adapter device shown in an open condition.
Figure 6:
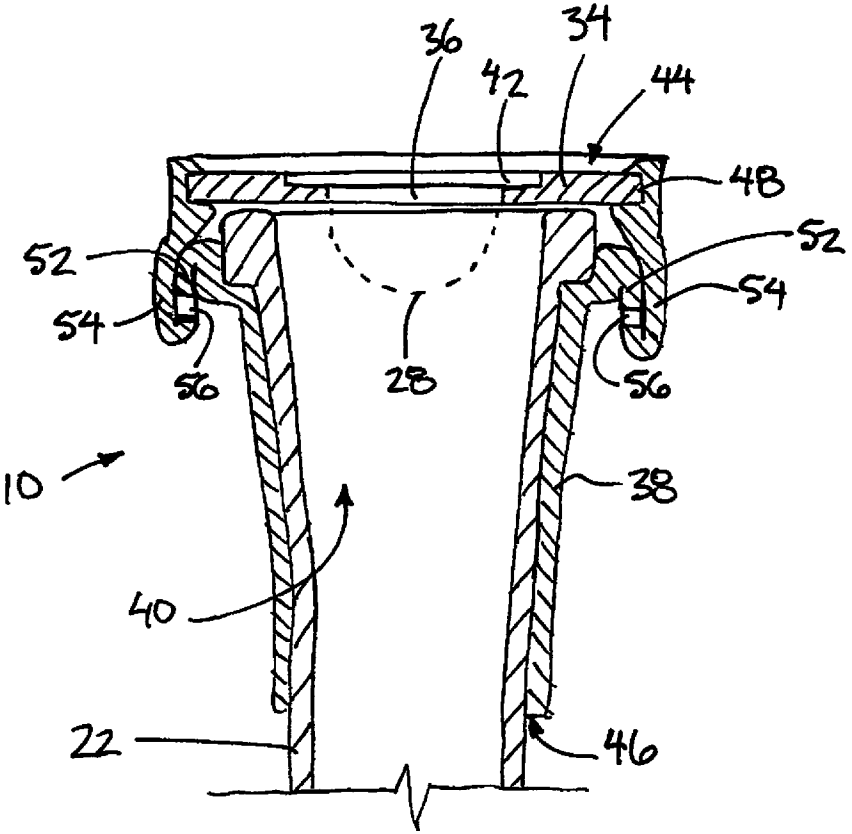
FIG. 6 is a sectional view of the screen adapter device according to the second embodiment of FIG. 4 shown in the closed condition.

Turning now to the second embodiment shown in FIGS. 4 through 6, the support body 38 in this instance is again frustoconical in shape while being elastically stretchable from a relaxed condition in which the bottom has an inner diameter which is less than the diameter of the smoke inlet tube to a stretched condition surrounding the inlet end of the smoke inlet tube to mount the bottom end of the support body in fixed relation onto the smoke inlet tube. The top end of the support body 38 is also similar to the embodiment described above in that there is provided a perimeter groove 48 that receives the perimeter edge of the adapter plate 34 therein to support the adapter plate relative to the top end of the support body 38.

In the second embodiment, the support body 38 includes an intermediate portion 50 between the bottom portion stretched about the smoke inlet tube 22 below and the top end locating the perimeter groove 48 that receives the adapter plate 34 above. The intermediate portion 50 includes a lower annular section 52 which is sloped upwardly and outwardly relative to the bottom portion of the support body 38 and an upper annular section 54 which is sloped upwardly and inwardly from the outer edge of the lower annular section 52. The upper and lower annular sections thus meet at a central apex defining the maximum outer diameter of the support body 38 about the circumference of the body.

A plurality of vent holes 56 are formed in the lower annular section 52 to communicate from the exterior of the support body to the passage within the interior thereof. The vent holes 56 are circumferentially spaced apart from one another and collectively define a vent which is operable between an open condition allowing the passage 40 within the support body to be externally vented through the vent holes and a closed condition in which the vent holes are closed so that the passage within the support body only communicates externally through the screen member 28 at the top end thereof.

In a normal operating position corresponding to an extended or open condition of the vent holes, as shown in FIGS. 4 and 5, the upper annular section 54 extends upwardly above the lower annular section 52 as described above. The adapter plate 34 is spaced above the top end of the smoke inlet tube 22 in the extended condition such that the adapter plate can be displaced downwardly from the extended condition to a folded or closed condition as shown in FIG. 6. In this instance, the adapter plate 34 can be located in close proximity to or directly abutted against the top end of the smoke inlet tube with the lower annular section 52 instead extending downwardly from the top end of the inlet tube 22 so that the upper annular section 54 lies directly against and alongside the lower annular section 52 along substantially the full height thereof. The overlapping of the upper annular section 54 against the lower annular section 52 effectively closes off any of the vent holes 56 located in the lower annular section as shown in FIG. 6.

In further embodiments, the vent holes may be located in a different portion of the support body 38 or in the adapter plate 34 with one or both of the adapter plate and the support body being manipulated to operate the vent holes between the open and closed conditions thereof.

Figure 7:
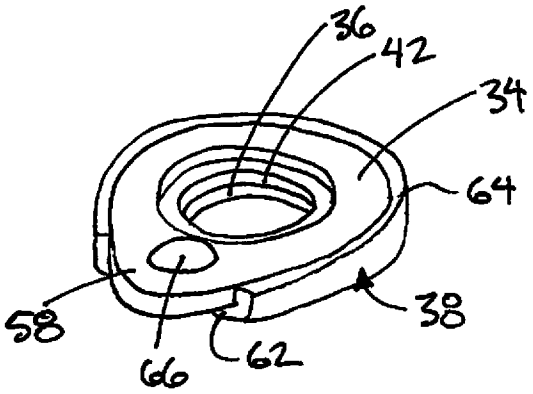
FIG. 7 is a perspective view of a third embodiment of the screen adapter device.
Figure 8:
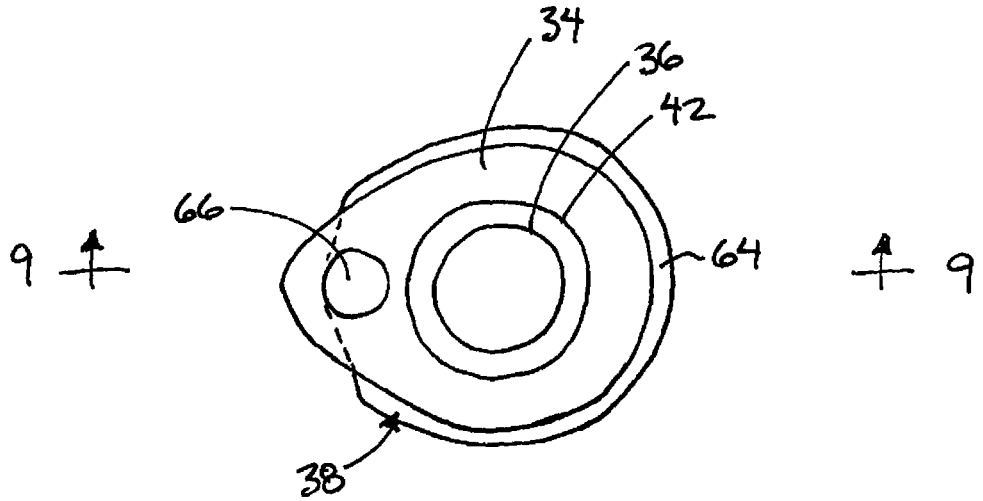
FIG. 8 is a top plan view of the screen adapter device according to the third embodiment of FIG. 7.

Turning now to the third embodiment of FIGS. 7 through 9, in this instance the adapter plate 34 includes both a round portion according to the previous embodiments and an additional lobe portion 58 extending outwardly beyond the perimeter of the round portion in one direction so that the overall shape of the adapter plate is elongated in one direction. The adapter plate thus has a teardrop shaped perimeter edge while remaining a singular flat body like the previous embodiments of the adapter plate. The screen aperture 36 in this instance is centrally located within the round portion. A further mounting aperture 60 is provided in this instance which is spaced from the screen aperture 36 so as to be offset in the direction of the lobe portion 58 to be partly received within the lobe portion.

According to the third embodiment, the support body comprises a bottom wall 62 which lies flat against the bottom of the adapter plate to fully span the round portion of the plate while an outermost part of the lobe portion 58 remains uncovered by the support body. The bottom wall 62 includes a screen opening extending therethrough which defines the passage 40 of the support body. The screen opening defining the passage 40 is located within the bottom wall in alignment with the screen aperture 36 of the adapter plate so that the bowl portion 30 of the screen member 28 extends through the passage 40 in the bottom wall 62 to be suspended below the bottom side of the bottom wall of the support body.

The support body 38 in this instance further includes an edge portion 64 extending upwardly from a portion of the perimeter of the bottom wall 62 for covering the perimeter edge of the round portion of the adapter plate 34, but not the perimeter edge of the lobe portion 58. The edge portion 64 has a height corresponding to the thickness of the adapter plate such that the edge portion of the support body 38 and the top surface of the adapter plate 34 are substantially flush with one another. The support body 38 further includes a plug portion 66 in the form of a post of resilient material that extends upwardly from the bottom wall 62 to fill the mounting aperture 60 within the adapter plate.

The bottom wall, the edge portion, and the plug portion of the support body 38 are all formed integrally with one another as a continuous, seamless, unitary body of material. The bottom side of the support body remains flat for abutment with the smoke inlet tube at the rim about the inlet opening of the smoke inlet tube to grip and seal relative to the rim about the full perimeter thereof. In the normal operating condition, the resilient support body 38 forms a complete seal between the rim of the smoke inlet tube 22 and the adapter plate 30 for locating the screen member 28 therein. The protruding lobe portion 58 of the adapter plate 34 can be readily gripped between a thumb and finger of a user to lift the adapter plate into a vented condition allowing air to bypass the screen member in an annular gap between the support body 38 and the open top end of the smoke inlet tube below.

According to a fourth embodiment (not shown), the adapter plate 34 can be used with the screen member 28 inserted therein without the use of any support body 38. In this instance, the adapter plate 34 itself can be supported directly onto the upper rim at the inlet end 24 of the smoke inlet tube 22. The adapter plate 34 in this instance is preferably configured in the manner of the adapter plate 34 shown in FIGS. 7 through 9 so as to be elongated in one direction to form a lobe portion 58 suitable for gripping in the fingers of a user to selectively lift the adapter plate from the smoke inlet pipe and bypass the screen member when desired.

Figure 10:
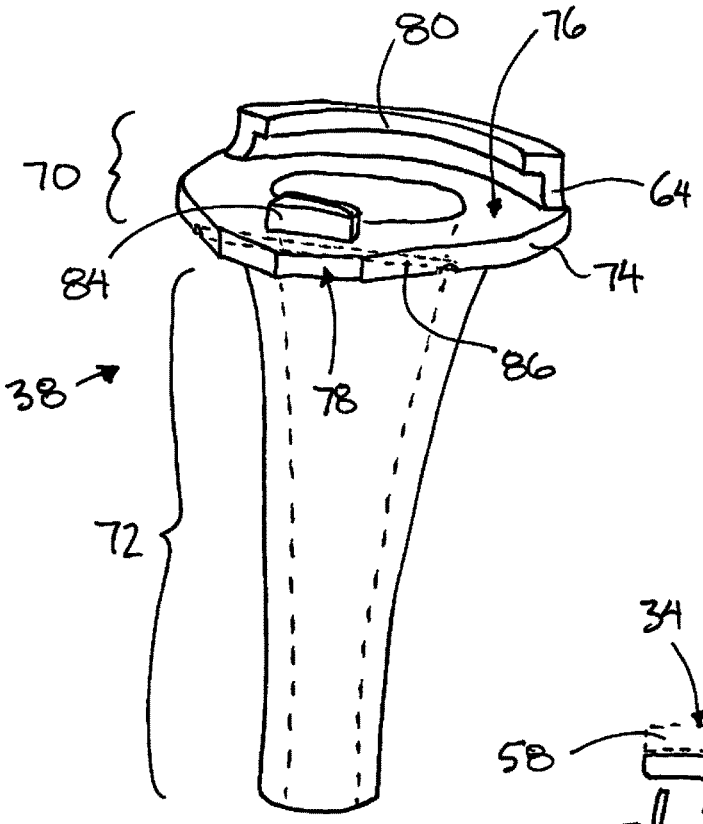
FIG. 10 is a perspective view of a further embodiment of the screen adapter device in which the adapter plate has been removed for illustrative purpose and in which the support body is adapted to receive an adapter plate therein which is identical to the adapter plate of FIGS. 7 through 9.
Figure 11:
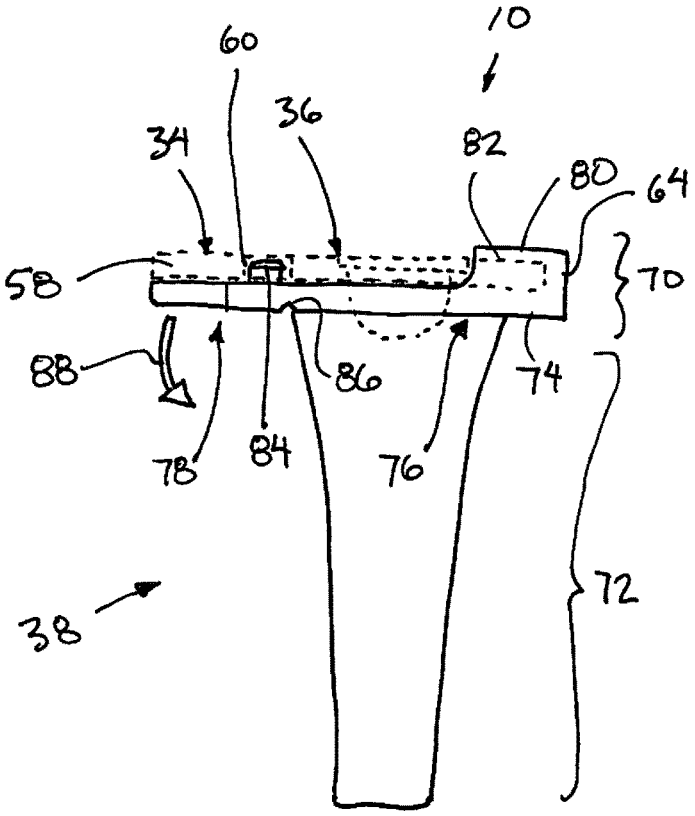
FIG. 11 is a side view of the screen adapter device according to the embodiment of FIG. 10 in which the adapter plate and the screen member are shown in broken line.

According to a further embodiment shown in FIGS. 10 and 11, the adapter plate 34 may again take the form of the plate shown in FIGS. 7 through 9 so as to define a lobe portion 58 with a mounting aperture 60 therein. The support body 38 in this instance includes an upper portion 70 supporting the adapter plate 34 therein and a lower portion 72 which tapers downwardly and inwardly from the upper portion 70 thereabove to a bottom end of the device.

The upper portion 70 has a flat plate body 74 with a flat upper surface that spans along the bottom side of the adapter plate 34. The overall perimeter shape of the flat plate body 74 of the upper portion 70 corresponds approximately to the perimeter shape of the adapter plate 34 so as to define a main circular section 76 and an elongated lobe portion 78 extending radially in one direction from the circular section similarly to the shape of the adapter plate 34. A central opening in the flat plate body 74 is aligned with the screen aperture in the adapter plate 34.

The upper portion 70 further includes an edge portion 64 extending upwardly from one end of the plate body 74 diametrically opposite from the lobe portion 78 such that the edge portion 64 extends partway about a perimeter edge of the adapter plate 34 at a location diametrically opposite from the lobe portion 58 of the adapter plate. A flange portion 80 is connected to the top of the edge portion to extend radially inwardly in overlapping arrangement over a perimeter edge portion of the upper surface 82 of the adapter plate 34. The flange portion 80 is a short flange which does not interfere with the screen aperture 36 or the counterbore 42 in the adapter plate by being spaced radially outward therefrom about the corresponding portion of the perimeter of the adapter plate.

The upper portion 70 of the support body further includes a plug in the form of a post 84 supported on the lobe portion 78 to extend upwardly beyond the upper surface 82 while being aligned with the mounting aperture 60 in the adapter plate 34 to be received snugly therein by interference fit. The post 84 is spaced radially outward from the screen aperture 36 and the adapter plate in a direction which is diametrically opposite from the edge portion 64 extending about part of the perimeter edge of the adapter plate.

The upper portion of the support body 38 further includes a groove 86 formed in the bottom side of the plate body 74 to be oriented tangentially relative to the lower portion 72 of the support body. The groove 86 extends fully across the width of the support body between opposing edge portions of the plate body 74 to define a line of weakness functioning as a folding axis that separates the lobe portion 78 from the remaining main circular section 76 of the plate body 74. In this manner, the lobe portion 78 of the support body can be folded downwardly and inwardly towards the lower portion 72 of the support body in the direction of arrow 88.

The post 84 is supported on the lobe portion so as to be movable with the lobe portion when folding about the fold axis. In this manner, the post 84 can be removed from the mounting aperture 60 in the adapter plate 34, which in turn then allows the adapter plate to be laterally slidable relative to the support body 38 for removal of the opposing perimeter edge portion of the adapter plate from the groove defined between the flat plate body 74 below the plate and the flanged portion 80 above the plate.

The lower portion 72 of the support body 38 is an elongate tubular structure which is tapered to be reduced in outer diameter from a maximum outer diameter at the top that is joined to the upper portion 70 to a minimum outer diameter at the bottom of the device. A passage 44 is defined extending through the tapered portion from a top opening in communication with the corresponding opening in the upper portion 70 that receives the screen member 28 therein to a bottom opening at the bottom end for open communication with the smoke inlet tube 22 within which the bottom end is received. The tapered lower portion 72 is sized such that the maximum diameter at the top end is greater than the inner diameter of the smoke inlet tube while the minimum diameter at the bottom end is less than the inner diameter of the smoke inlet tube to allow insertion of the bottom end into the smoke inlet tube similar to the configuration shown in FIG. 3.

The outer diameter at the top end of the lower portion 72 is less than the diameter of the circular section 76 of the plate body 74 of the upper portion 70 such that the upper portion protrudes radially outward from the top end of the tapered portion about the full circumference thereof. In this instance the support body 38 may also be suited for use with larger diameter smoke inlet tubes 22 having an interior diameter which is greater than the maximum diameter of the lower portion 72 as the flat bottom side of the upper portion 70 protruding radially outward beyond the lower portion 72 can instead be engaged upon the rim at the inlet end of the smoke inlet 222 while the lower portion 72 is fully received within the smoke inlet tube 22.

In use, the adapter plate 34 is arranged to span across and enclose the open inlet end of the smoke inlet tube 22 either by placement of the plate 34 directly upon the smoke inlet tube, or by mounting the plate 34 into a support body 38 which is in turn supported to span across the open end of the inlet tube 22. In either instance, the screen member 28 is frictionally fit into the screen aperture 36 in the adapter plate 34 so that a smoking substance can be combusted within the screen member and any air drawn into the pipe 12 must pass through the screen member 36 for drawing smoke from the combustion of the smoking substance into the pipe 12. The adapter plate 34, and the support body 38 if present, can be readily removed from the smoke inlet pipe 22 by lifting the device 10 from the inlet tube 22 in most instances to allow air to be drawn into the inlet tube 22 while bypassing the screen member 28 when desired.

The screen member remains readily removable from the adapter plate by overcoming the friction retaining the screen member within the screen aperture of the adapter plate for ease of cleaning or replacement of the screen member 28 when desired.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An adapter device in combination with a screen member, the adapter device being arranged for supporting the screen member relative to a smoke inlet tube of a water pipe including a water container coupled between a drawtube and the smoke inlet tube, the screen member including (i) a bowl portion comprising a mesh in a semi-spherical shape with an open top end and (ii) an annular flange extending radially outward from an upper rim of the bowl portion about the open top end, the adapter device comprising:

an adapter plate comprising a flat body having a screen aperture extending through the adapter plate from a top side to a bottom side of the adapter plate;

the adapter plate receiving the annular flange of the screen member engaged thereon such that (i) the bowl portion of the screen member is releasably received within the screen aperture and (ii) a bottom of the bowl portion is spaced below the bottom side of the adapter plate; and the adapter plate having an outer diameter which is greater than an inner diameter of an inlet end of the smoke inlet tube whereby the adapter plate is arranged to be supported spanning across the inlet end of the smoke inlet tube.

2. The device according to claim 1 wherein the screen aperture includes a counterbore formed at the top side of the adapter plate, the counterbore being sized to receive the annular flange of the screen member therein so as to be arranged to suspend the bowl portion within the screen aperture.

3. The device according to claim 1 wherein the screen member is frictionally retained relative to the adapter plate by interference fit between the bowl portion and the screen aperture.

4. The device according to claim 1 further comprising a support body joined to the adapter plate and being arranged to support the adapter plate on the smoke inlet tube, the support body having a passage therethrough arranged for communication between the screen aperture in the adapter plate and an open inlet end of the smoke inlet tube when the adapter plate is supported on the smoke inlet tube by the support body.

5. The device according to claim 4 wherein the support body is formed of a resilient gripping material having a high coefficient of friction relative to a material of the smoke inlet tube of the water pipe.

6. The device according to claim 4 wherein the support body is frustoconical in shape so as to be reduced in diameter from a top end to a bottom end of the support body, the passage in the support body extending from a top opening at the top end which is sized to support the adapter plate therein to a bottom opening at the bottom end, the bottom opening being reduced in diameter relative to an inner diameter of the open inlet end of the smoke inlet tube such that the bottom end of the support body is arranged to be received within the smoke inlet tube.

7. The device according to claim 6 wherein the bottom end of the support body is elastically deformable from a relaxed state in which the bottom opening is reduced in diameter relative to the inner diameter of the smoke inlet tube and a stretched state in which the bottom opening is increased diameter relative to an outer diameter at the open inlet end of the smoke inlet tube.

8. The device according to claim 4 further comprising a vent formed in the support body, the vent being operable between an open condition in which the passage in the support body is vented externally through the vent and a closed condition in which the passage in the support body can only communicate externally through the screen aperture when supported on the smoke inlet tube.

9. The device according to claim 4 wherein the support body comprises a bottom wall which is flat and lies against a bottom side of the adapter plate, the bottom wall having a screen opening therein in alignment with the screen aperture, the screen opening defining the passage through the support body.

10. The device according to claim 9 wherein the support body comprises an edge portion extending upwardly from a perimeter of the bottom wall of the support body about a portion of a perimeter of the adapter plate.

11. The device according to claim 9 wherein the adapter plate comprises a mounting aperture therein spaced from the screen aperture, wherein the support body comprises a plug extending upwardly from the bottom wall so as to fill the mounting aperture in the adapter plate, and wherein the adapter plate comprises a main body portion having a diameter which is greater than a diameter of the open inlet end of the smoke inlet tube and a lobe portion which is elongated in one direction relative to the main body portion in which the mounting aperture is located at least partially in the lobe portion.

12. The device according to claim 4 further comprising:

the adapter plate comprising a main body portion having a diameter which is greater than a diameter of the open inlet end of the smoke inlet tube and a lobe portion which is elongated in one direction relative to the main body portion;

the support body including an upper portion retaining the adapter plate thereon and a tapered portion extending downwardly from the upper portion, the passage in the support body extending from a top opening in the upper portion in alignment with the screen aperture to a bottom opening at the bottom end, the bottom opening being reduced in diameter relative to an inner diameter of the open inlet end of the smoke inlet tube such that the bottom end of the support body is arranged to be received within the smoke inlet tube.

13. The device according to claim 12 wherein the upper portion of the support body includes an edge portion extending about part of a perimeter edge of the adapter plate opposite from the lobe portion of the adapter plate and a retainer flange extending from the edge portion overtop of an upper surface portion of the adapter plate to retain the adapter plate on the upper portion of the support body.

14. An adapter device in combination with a screen member, the adapter device being arranged for supporting the screen member relative to a smoke inlet tube of a water pipe including a water container coupled between a draw-tube and the smoke inlet tube, the screen member including (i) a bowl portion comprising a mesh in a semi-spherical shape with an open top end and (ii) an annular flange extending radially outward from an upper rim of the bowl portion about the open top end, the adapter device comprising:

an adapter plate having a screen aperture extending through the adapter plate from a top side to a bottom side of the adapter plate;

wherein the adapter plate receives the annular flange of the screen member engaged thereon such that (i) the bowl portion of the screen member is releasably received within the screen aperture and (ii) a bottom of the bowl portion is spaced below the bottom side of the adapter plate;

wherein the adapter plate has an outer diameter which is greater than an inner diameter of an inlet end of the smoke inlet tube whereby the adapter plate is arranged to be supported spanning across the inlet end of the smoke inlet tube; and wherein the screen aperture includes a counterbore formed at the top side of the adapter plate, the counterbore receiving the annular flange of the screen member therein so as to suspend the bowl portion from the annular flange within the screen aperture.

15. The device according to claim 14 wherein the adapter plate comprises a flat body formed of glass.

16. The device according to claim 14 wherein the counterbore is sized to receive the annular flange of the screen member therein such that the annular flange of the screen member is substantially flush with the top side of the adapter plate.

17. An adapter device in combination with a screen member, the adapter device being arranged for supporting the screen member relative to a smoke inlet tube of a water pipe including a water container coupled between a draw-tube and the smoke inlet tube, the screen member including (i) a bowl portion comprising a mesh in a semi-spherical shape with an open top end and (ii) an annular flange extending radially outward from an upper rim of the bowl portion about the open top end, the adapter device comprising:

an adapter plate having a screen aperture extending through the adapter plate from a top side to a bottom side of the adapter plate;

wherein the adapter plate receives the annular flange of the screen member engaged thereon such that (i) the bowl portion of the screen member is releasably received within the screen aperture and (ii) a bottom of the bowl portion is spaced below the bottom side of the adapter plate; and wherein the screen member is frictionally retained relative to the adapter plate by interference fit between the bowl portion and the screen aperture.

18. The device according to claim 17 in combination with the water pipe, wherein an outer diameter of the bowl portion of the screen member is within one millimeter less than an inner diameter of the smoke inlet tube whereby the screen member assists in centering the screen member relative to the smoke inlet tube.

19. An adapter device in combination with a screen member, the adapter device being arranged for supporting the screen member relative to a smoke inlet tube of a water pipe including a water container coupled between a draw-tube and the smoke inlet tube, the screen member including (i) a bowl portion comprising a mesh in a semi-spherical shape with an open top end and (ii) an annular flange extending radially outward from an upper rim of the bowl portion about the open top end, the adapter device comprising:

an adapter plate having a screen aperture extending through the adapter plate from a top side to a bottom side of the adapter plate;

wherein the adapter plate receives the annular flange of the screen member engaged thereon such that (i) the bowl portion of the screen member is releasably received within the screen aperture and (ii) a bottom of the bowl portion is spaced below the bottom side of the adapter plate; and wherein the adapter plate includes (i) a round portion defining a circular perimeter and (ii) a lobe portion protruding outwardly from the circular perimeter of the round portion in one direction, whereby the round portion and the lobe portion collectively define a singular flat body which is elongated in said one direction such that the lobe portion is suitable for gripping between a thumb and finger of a user while the adapter plate is engaged upon the smoke inlet tube.

20. The device according to claim 19 wherein the singular flat body of the adapter plate is formed of glass.

21. The device according to claim 19 wherein the adapter plate includes an auxiliary aperture extending through the plate at a location spaced from the screen aperture so as to be at least partly located within the lobe portion.

* * * * *